US006705540B2

(12) United States Patent
Koshiyama et al.

(10) Patent No.: US 6,705,540 B2
(45) Date of Patent: Mar. 16, 2004

(54) FLUID SPRAY APPARATUS

(75) Inventors: Hideya Koshiyama, Hitachi (JP); Takuya Koshiyama, Hitachi (JP)

(73) Assignee: Hideya Koshiyama, Hitachi (JP)

( * ) Notice: Subject to any disclaimer, the term of this patent is extended or adjusted under 35 U.S.C. 154(b) by 0 days.

(21) Appl. No.: 10/076,422

(22) Filed: Feb. 19, 2002

(65) Prior Publication Data

US 2002/0130196 A1 Sep. 19, 2002

(51) Int. Cl.[7] ..... B05B 17/08

(52) U.S. Cl. ..... 239/17; 239/22; 239/23; 239/505; 239/513; 239/514; 239/523; 239/524

(58) Field of Search ..... 239/16, 17, 18, 239/20, 22, 23, 451, 456, 505, 514, 513, 515, 589, 523, 524; 40/406

(56) References Cited

U.S. PATENT DOCUMENTS 3,101,176 A * 8/1963 Goss ..... 239/524
3,462,085 A * 8/1969 Nugarus ..... 239/515
3,747,851 A * 7/1973 Conrad ..... 239/524
3,785,572 A * 1/1974 Arnold et al. ..... 239/518
3,958,760 A * 5/1976 Rosenberg ..... 239/524
4,681,263 A * 7/1987 Cockman ..... 239/524
5,368,228 A * 11/1994 Adamson et al. ..... 239/524

* cited by examiner

*Primary Examiner*—Steven J. Ganey
(74) *Attorney, Agent, or Firm*—Antonelli, Terry, Stout & Kraus, LLP

(57) ABSTRACT

A nozzle unit of a liquid spray apparatus is constituted by a conduit tube having an outer portion spreading and curvature shape upper inner wall, a disc shape flat plate cover arranged on an upper portion of the conduit, and a coupling. Between the flat plate cover and the conduit tube a spray port of the nozzle unit is formed. From the spray port of the liquid spray apparatus, a thin film liquid (a thin film spray body) is sprayed. To this thin film liquid a swirl component (a squint direction component) is given and run down, to the thin film liquid a liquid pressure fluctuation generates, the pulsation movement is given to the thin film liquid. In a case where a nozzle unit has a ring shape spray port a melon shape spherical thin film spray body is formed and in a case where a nozzle unit has a linear shape spray port a circular shape thin film spray body is formed. The liquid spray apparatus in which a thin film spray body can reach to a desirable run down point without the scattering of the liquid droplets and without the film cut off according to the pulsation can be obtained.

14 Claims, 7 Drawing Sheets

FIG. 6

Actual Measurement Data

| Substances to be measured | | | Collection Amount | | | | | | | Reference |
|---|---|---|---|---|---|---|---|---|---|---|
| Substance Name | Chemical Formula | Unit | Lapse Time (hr) | | | | | | | |
| | | | 0 | 0.5 | 1 | 3 | 6 | 12 | 24 | |
| Pollen | —— | g | 0 | 0.6 | 1.2 | 2.1 | 2.5 | 2.8 | 3.1 | Addition 5 g<br>5 g → 1.9g |
| Nicotine | $CH_3N(CH_3)CH(CH_2CH_2CH_2)NCH_3$ | ppm | 0 | 6.0 | 12.0 | 37.0 | 63.0 | 80.0 | 91.0 | Concentration<br>2,000 → 1,200ppm |
| Formaldehyde | HCHO | ppm | 0 | 55.0 | 65.0 | 80.0 | 82.0 | 84.0 | 85.0 | Concentration<br>1,500 → 900ppm |
| Ammonia | $NH_4^+$ | ppm | 0 | 54.0 | 65.0 | 65.0 | 65.0 | 68.0 | 70.0 | Concentration<br>750 → 300ppm |
| Toluene | $C_6H_5CH_3$ | ppm | 0 | 5.0 | 6.0 | 4.5 | 5.5 | 5.0 | 6.0 | Concentration<br>500 → 400ppm |
| Chlorine | $Cl^-$ | ppm | 0 | 2.0 | 3.0 | 8.0 | 11.0 | 10.0 | 10.2 | Concentration<br>360 → 250ppm |
| Nitric Acid | $NO_3^-$ | ppm | 0 | 0.6 | 0.7 | 0.8 | 0.9 | 0.8 | 0.9 | Concentration<br>620 → 590ppm |
| Sodium | $Na^+$ | ppm | 0 | 0.06 | 0.1 | 0.15 | 0.2 | 0.25 | 0.3 | —— |

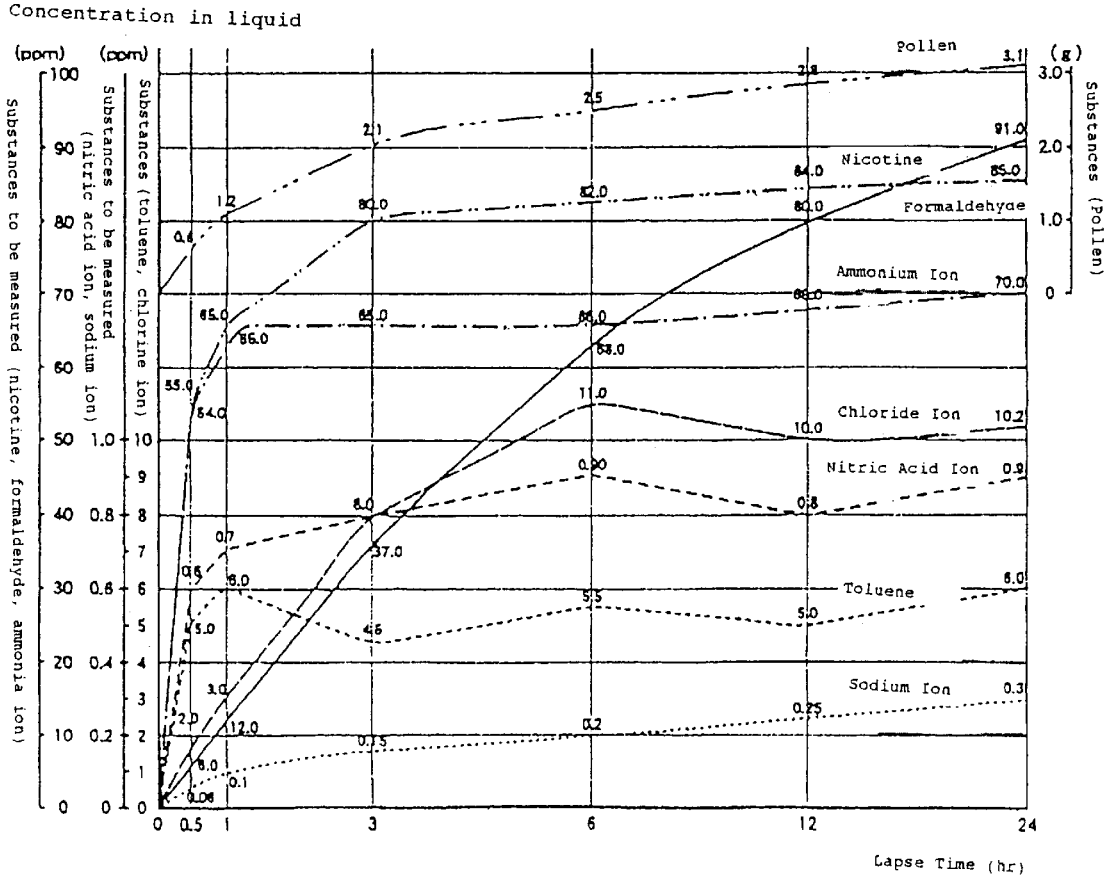

FLUID SPRAY APPARATUS

BACKGROUND OF THE INVENTION

1. <Technical Field>

The present invention relates to a fluid spray apparatus and particularly to a fluid spray apparatus for use in an indoor room, an outdoor pond, a garden pond and a courtyard pond suitable for generate the minus ions according to Lenard effect.

2. <Prior Art>

It has known that when a lump of water turns out fine the minus ions generate according to Lenard effect. To realize the generation of the minus ions according to Lenard effect, the fountain is effective. As a conventional technique of a liquid spray apparatus (a fountain apparatus) for forming the liquid with a thin film shape, it has known a liquid spray apparatus (a fountain apparatus) having a nozzle unit shown in FIG. 14 and FIG. 15.

The conventional liquid spray apparatus (the fountain apparatus) having a nozzle unit 100 shown in FIG. 14 has used in an outdoor such as a public garden. This nozzle unit 100 comprises a conduit tube 101 having a vertical inner wall 100*a* and a flat plate 102 arranged on an upper portion of the conduit tube 101. The flat plate 102 has a central tube portion 102*a* which extends toward a lower portion and a smooth curvature portion 102*b* in a lower face. The liquid (water) pressurized by a pressure water pump collides with the curvature portion 102*b* of the flat plate 102 and due to a reaction of the kinetic energy a spherical shape thin film spray body (the fountain) WF11 generates. In the above liquid spray apparatus having the nozzle unit 100, in a lower portion of the generated thin film shape fountain WF11 since a film cut off phenomenon occurs and further since the liquid droplets scatter in a surrounding portion, this apparatus is not suited for an indoor use. In this liquid spray apparatus having the nozzle unit 100, the spherical shape thin film spray body WF11 is an aggregated body of the lower portion extending liquid flow but has no inclination direction component. The liquid (water) sprays in a linear shape radial direction and the spherical shape thin film spray body WF11 runs down vertically without the pulsation.

On the other hand, in a conventional liquid spray apparatus (a fountain apparatus) having a nozzle unit 200 shown in FIG. 15 has used in an indoor. The nozzle unit 200 is constituted with a conduit tube 201, a disk 202 and a coupling 203. A screw portion of a lower portion of the disk 202 is engaged with a screw portion of a member 202*b* which is mounted on an inner side lower portion of the conduit tube 201. The conduit tube 201 and the coupling 203 are engaged with screws 204. In this nozzle unit 200, a curvature portion 201*b* is formed on an inner wall of the conduit tube 201 and a curvature portion 202*a* is formed on a lower face of the disk 202. A flow passage of the liquid (water) supplied from a pressure water pump forms to have a substantially same cross-sectional area between the curvature portion 201*a* of an inner portion of the conduit tube 201 and the curvature portion 202*a* of the disk 202. In the liquid spray apparatus having the above nozzle unit 200, since the film cut off of the generated spherical shape thin film spray body (fountain) hardy occur it is suited for the indoor use, but during a staring of the pressure water pump this apparatus has a defect in which from a spray port of the liquid spray apparatus the liquid droplets scatter to an outer side surrounding portion.

Further, in the conventional liquid spray apparatus having the above nozzle unit 200, to make the flow passage cross-sectional area constant, to the liquid the restraint is added, accordingly the load of the pressure water pump increases. As a result, in the above liquid spray apparatus, it is necessary to set a head of water and a discharge amount in the pressure water pump, since an abrupt discharge pressure during the pump starting, from the spray port the liquid droplets scatter and by the employment of the large size pressure water pump the big operation noises occur and further a motive power becomes high.

Further, when the conventional liquid spray apparatus is mounted on an interior, during the starting the liquid droplets scatter to an outer side of the interior and a surrounding portion becomes dart, as a result it is impossible to use the liquid spray apparatus with the safety.

SUMMARY OF THE INVENTION

An object of the present invention is to provide a fluid spray apparatus wherein a thin film spray body can reach to a desirable run down point by pulsating without a film cut off.

Another object of the present invention is to provide a fluid spray apparatus wherein the swirl movement is added simultaneously to a thin film spray body.

A further object of the present invention is to provide a fluid spray apparatus wherein a scattering of liquid droplets from a spray port can be prevented.

A furthermore object of the present invention is to provide a fluid spray apparatus wherein a size of a thin film spray body can be compensated voluntary.

A still further object of the present invention is to provide a fluid spray apparatus wherein the needs for healing and the good health can be responded.

So as to attain the above stated objects, in the liquid spray apparatus according to the present invention, in a liquid spray apparatus comprising a liquid pressurizing means having a suction port for inhaling the liquid and a discharge port for discharging the liquid and for pressurizing the liquid, a liquid passage forming member communicated to the discharge port of the liquid pressurizing means, and a nozzle unit communicated to a discharge side of the liquid passage forming member and having a liquid spray port, the liquid sprayed from the liquid spray port of the nozzle unit is formed with a thin film shape liquid.

The liquid pressurizing means generates a liquid pressure fluctuation to the liquid and gives a pulsation movement on a surface of the thin film shape liquid, and the thin film liquid sprayed from the liquid spray port of the nozzle unit is maintained in a thin film figuration to a desirable run down point without a film cut off.

The liquid pressurizing means gives a swirl component to the liquid and gives a squint direction component to the thin film shape liquid and makes to run down the thin film shape liquid, and the thin film shape liquid sprayed from the liquid spray port of the nozzle unit is maintained in a thin film figuration to a desirable run down point without a film cut off.

The liquid pressurizing means generates a liquid pressure fluctuation to the liquid and gives a pulsation movement on a surface of the ring shape thin film shape liquid, and the thin film shape liquid sprayed from the ring shape liquid spray port of the nozzle unit is maintained in a ring shape thin film figuration to a desirable run down point without a film cut off.

The nozzle unit comprises a first nozzle member having an outer portion spreading curvature face shape upper portion inner wall and a second nozzle member arranged on an upper portion of the first nozzle member and having a flat lower face, the nozzle unit mitigates the pressure of the liquid pressurized abruptly which generates during a starting of the fluid pressurizing means, and the ring shape thin film liquid sprayed from the ring shape liquid spray port of the nozzle unit is maintained in a ring shape thin film figuration to a desirable run down point without a thin cut off.

The nozzle unit comprises a first nozzle member having an outer portion spreading curved face shape upper portion inner wall, a second nozzle member arranged on an upper portion of the first nozzle member and having a flat lower face, and a member provided between the first nozzle member and the second nozzle member and for adjusting a space of the liquid spray port, the nozzle unit mitigates the pressure of the liquid pressurized abruptly which generates during a starting of the fluid pressurizing means, the ring shape thin film liquid sprayed from the ring shape liquid spray port of the nozzle unit is maintained in a ring shape thin film figuration to a desirable run down point without a film cut off, and by adjusting the spray port space adjusting member of the nozzle unit, the space of the liquid spray port is changed and a figuration of the ring shape thin film liquid is compensated.

BRIEF DESCRIPTION OF DRAWINGS

FIG. 6 is an actual measurement data showing the air purification performances of the liquid spray apparatus of one embodiment according to the present invention;

DESCRIPTION OF THE INVENTION

An interior on which a fountain apparatus being a liquid spray apparatus of one embodiment according to the present invention is mounted will be explained.

Figure 1:
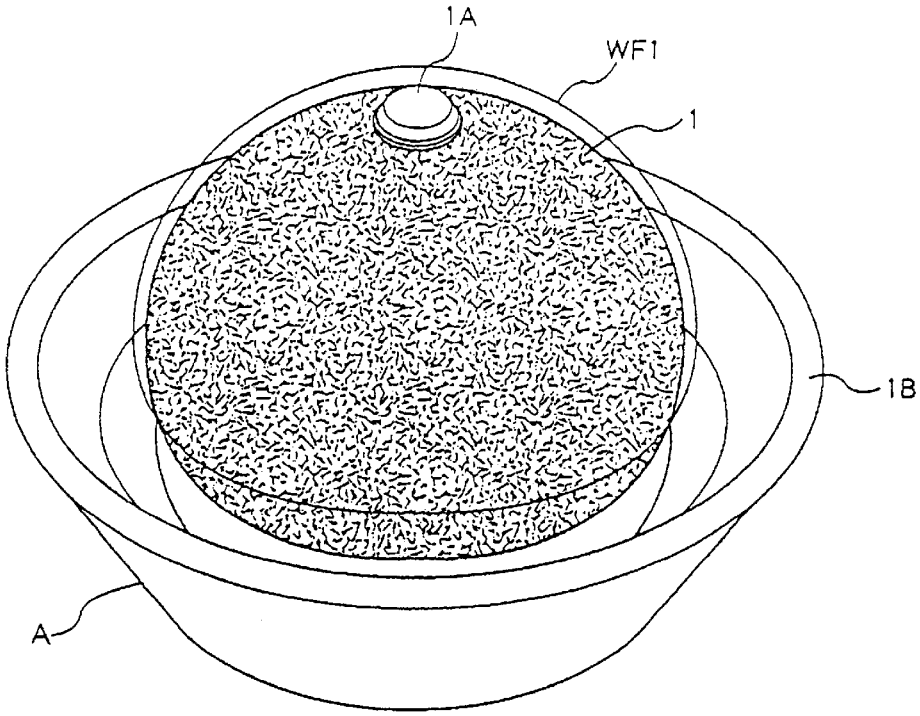
FIG. 1 is an outer appearance perspective view showing an interior on which a liquid spray apparatus of one embodiment according to the present invention is mounted.
Figure 2:
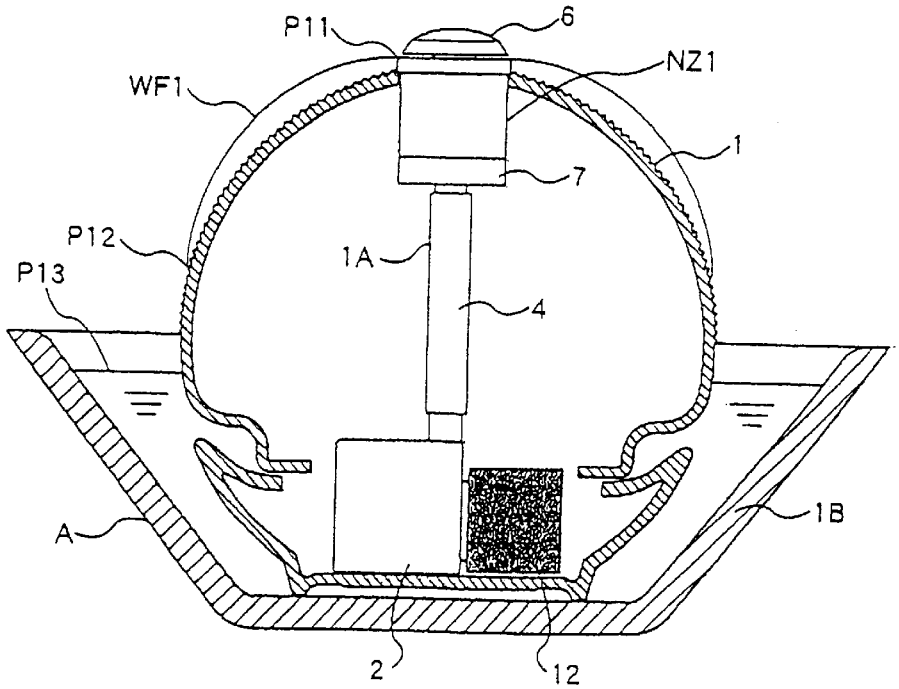
FIG. 2 is a cross-sectional view showing the interior on which the liquid spray apparatus of one embodiment according to the present invention is mounted.
Figure 3:
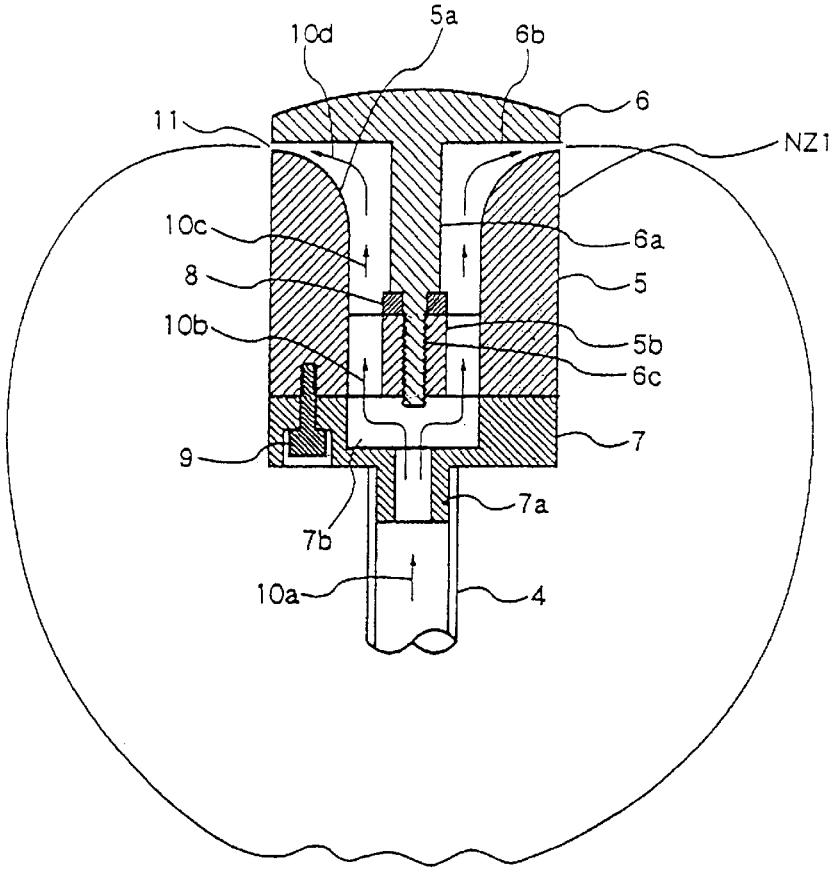
FIG. 3 is a cross-sectional view showing a nozzle unit of the liquid spray apparatus of one embodiment according to the present invention.
Figure 4:
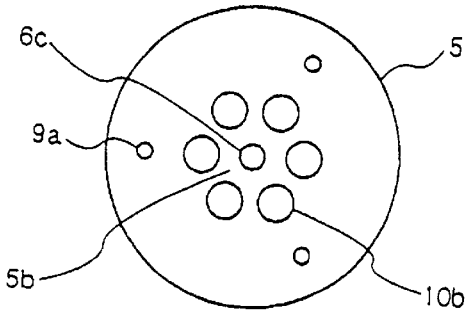
FIG. 4 is a plan view showing a condition taken from a lower portion off which a coupling in FIG. 3 is taken.
Figure 5:
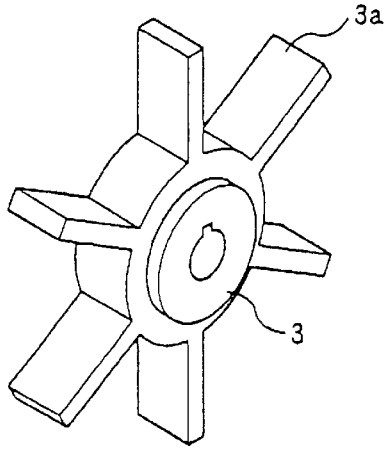
FIG. 5 is an outer appearance perspective view showing a pump impeller of the liquid spray apparatus of one embodiment according to the present invention.

FIG. 1 is an outer appearance perspective view of an interior to which a liquid spray apparatus of one embodiment according to the present invention is mounted; FIG. 2 is a cross-sectional view of the interior to which the liquid spray apparatus of one embodiment according to the present invention is mounted; FIG. 3 is a cross-sectional view a surrounding portion of a nozzle unit of the liquid spray apparatus of one embodiment according to the present invention; FIG. 4 is a plan view in which a part off which a coupling is removed is taken from a lower portion; and FIG. 5 is an outer appearance perspective view of an impeller of a pressure water pump.

The interior on which the fountain apparatus being the liquid spray apparatus of one embodiment according to the present invention is mounted will be explained referring to FIG. 1 and FIG. 2. This embodiment is the interior to which the liquid spray apparatus wherein the water sound is eliminated and is suitable for a bedroom is mounted.

An interior A is constituted with a spherical shape pottery 1 having a liquid spray apparatus 1A of one embodiment according to the present invention and a pottery type water ball 1B. To an interior portion of the water ball 1B (diameter 40–50 cm) for receiving the liquid (water), the spherical shape pottery 1 (diameter 25 cm) being a base for consisting a part of the liquid spray apparatus 1A is installed. The liquid spray apparatus 1A is mounted in a central portion of an interior portion of the pottery 1. A pressure water pump 2 is accommodated in a lower portion of the pottery 1. The pressure water pump 2 gives the tornado swirl movement against the water from the water ball 1B from a suction port of the pressure water pump 2 to a nozzle unit NZ1.

In a fountain apparatus being the liquid spray apparatus 1A, as shown in FIG. 3 and FIG. 4, the nozzle unit NZ1 comprises mainly a cylindrical conduit tube 5, a disk shape flat plate cover 5, and a coupling 7. The flat plate cover 6 has a substantial T shape cross-section and has a lower portion extending central cylindrical portion 6*a* and a flat face portion 6*b* in a lower face. The conduit tube 5 and the flat plate cover 6 which constitute the nozzle unit NZ1 are engaged with a female screw engaging portion 5*b* of the conduit tube 5 and a male screw engaging portion 6*c* of the flat plate cover 6. To this engaging portion, a spacer 8 is intervened. To a lower end of the conduit tube 5, the coupling 7 is fixed with a screw member 9 which is inserted into a screw hole 9*a*. The spacer 8 adjusts a space width of a ring shape spray port 11 which is formed between the flat face portion 6*b* of the lower face of the flat plate cover 6 and a smoothly curvature face portion 5*a* of the conduit tube 5 and also compensates a figuration of a thin film spray body WF1. In the interior portion of the pottery 1, a filter is received.

In the above stated embodiment, the disk shape flat plate cover 6 is manufactured by aluminum and stainless steel etc, and the central cylindrical portion 6*a* and the flat face portion 6*b* are made with a right angle. This disk shape flat plate cover 6 may be manufactured by the synthetic resin, for example ABS resin. In this case, the right angle portion between the central cylindrical portion 6*a* and the flat face portion 6*b* prevents the stress during the formation process and to maintain the size accuracy the above right angle portion is connected with a curvature face.

The fluid (water) pressurized by the pressure pump 2 passes through a passage 10*a* in a hose 4 and reaches to a connection portion 7*a* of the hose 4 of the coupling 7. The fluid further passes through an inner chamber 7*b* of the coupling 7 and reaches to the spray port 11 through passages 10*b,* 10*c,* and 10*d* of the conduit tube 5 and then sprayed therefrom. The liquid pressurized abruptly during the starting of the pressure pump 2 collides with the flat face portion 6*b* of the lower face of the flat plate cover 6 and the pressure is mitigated. The liquid with the successively sent liquid flows along to a inner wall curvature portion 5*a* of the conduit tube 5 and sprays with the ring shape from the spray port 11. The sprayed liquid becomes a melon shape thin film spray body (fountain) WF1.

An impeller 3 of the pressure pump 2 will be explained referring to FIG. 5. Plural blades 3*a* of the impeller 3 are installed with the radial shapes. The impeller 3 is used to generate a flow amount and a head of water and has the linear shape and radial shape blades 3*a.* By the employment of the impeller 3 of the pressure pump 2 having the linear shape and radial shape blades 3*a,* to the generated sprayed liquid the pulsation pressure fluctuation suited to a rotation number of the blade 3*a* and a number of the blades 3*a* acts on and then the pulsation movement is added on a surface of the above stated thin film spray body WF1. The pressure pump 2 having the linear shape and radial shape blades 3*a* gives the pulsation pressure fluctuation against to the liquid to be sprayed. Further, the pressure pump 2 gives the tornado whirl movement to the fluid to the water ball 1B from the nozzle unit NZ1.

By the rotation of the blades 3*a* of the impeller 3, the head ability generates. According to the linear shape and radial shape blades 3*a,* against to the flowing water the water pressure fluctuation generates and the surface of the thin film spray body WF1 vibrates in all ways and the vibrated liquid reaches to from an outlet point p11 of the spray port 11 to an outer surface p12 which is a reaching point of the pottery 1. The liquid is conveyed to an outer wall face of the pottery 1 from the outer surface p12 of the pottery 1 and runs down to a water surface p13. Further, the thin film spray body WF1 is an aggregation of the curved shape flow liquid and is sprayed in a radial direction (a radius direction) having an inclination (squint) direction angle.

Namely, the liquid droplets change with the curved shape from the outlet point p11 of the spray port 11 of the nozzle unit NZ1 and reach to the outer surface p12 which is a desirable run down point. The thin film spray body WF1 having the ring shape and the melon shape which is sprayed from the ring shape spray port 11 is the aggregation of the liquid droplets and has the inclination (squint) direction component and is sprayed with the curvature shape. The thin film spray body WF1 runs down to the reaching surface p12 of the pottery 1 with the pulsation but without the film cut off (the film tearing).

According to the pressure pump 2 having the linear shape and the radial shape blades 3*a,* the thin film spray body WF1 is given the pulsation movement and the swirl movement. Namely, according to the surface the pulsated thin film spray body WF1, the contact area and the contract frequency between the water molecular and the air molecular increases. As a result, according to the adsorption force in the water molecular, the air purification effect (the air cleaning effect) promotes. Further, in a case where the embodiment of the thin film spray body WF1 is the spherical shape, until one water molecular reaches to from the spray port 11 to the outer surface p12, since the liquid runs down to a position which is slipped out from a sprayed position by the whirl movement, the contact area between the water molecular and the air molecular is held long. Even it is the small size thin film spray body WF1, the air purification effect is promoted and further as stated in above the scattering of the liquid droplets according to the liquid cut off in the run down midway is prevented. Further, since the air molecular and the water molecular collides with, Lenard effect is promoted and the generation of the minus ions increases.

In the case where the embodiment of the thin film spray body WF1 is the spherical shape, according to the swirl movement, the thin film spray body WF1 is not cut off surely during the run down and reaches to the water surface. According to the run down in a longitudinal direction and the swirl in the lateral direction, the thin film spray body WF1 is held with the spherical shape and is not cut off to the outer surface p12 and as a result the scattering the liquid droplets is prevented. In this case, before the inertia of the swirl movement added to the water disappears, to discharge the liquid from the spray port 11, the length of the flow passage and the cross-sectional area of the flow passage are formed.

Further, the thin film melon shape spray body WF1 pulsates having the radial direction (the radius direction) having the squint direction angle and runs down to the outer surface p12 of the pottery 1 which is the reaching point of the desirable run down point without the film cut off. According to the pressure pump 2, to the generated discharge water, the pulsation fluctuation acts on and to the surface of the above stated thin film spray body WF1 the pulsation movement is added.

The run down thin film spray body WF1 flows along to the outer surface of the pottery 1 from the reaching outer surface p12 and the knocking of the liquid becomes minimum and then the non-sound operation carries out and continues. The generation of the minus ions according to Lenard effect increases by the provision of the fine uneven portions to the outer surface of the pottery 1.

The liquid spray apparatus 1A of the above stated embodiment according to the present invention will be explained further. The diameter of the thin film spray body WF1 is about 50–60 cm, wherein the liquid spray amount of the pressure pump 2 is about 10 litters/minute, the head of water is 160 cm, and the space width of the spray port 11 is 1.0 mm. The liquid spray apparatus can be installed on the indoor room and the outdoor pond, in the garden pond, etc. The restraint of the abrupt discharge energy generated during the starting can be solved by an employment of an inverter type pressure pump motor.

According to the liquid spray apparatus 1A of the above stated embodiment of the present invention, the melon shape thin film spray body WF1 having a large surface area (diameter about 60 cm) generates. The generated spray body WF1 hardly occurs the film cut off phenomenon and also the liquid droplet scattering during the starting is prevented.

The melon shape thin film spray body WF1 having the large surface area carries out a purification effect of the indoor air. According to Lenard effect, the minus ions generate during the liquid spray and during the run down collision of the thin film spray body WF1 and are supplied in the indoor room.

In the liquid in the interior portion of the water ball 1B, since an environment disinfecting agent is added, the bacteria caught with the dusts is sterilized and a comfortable space is provided. The fountain in the indoor room provides a refreshing and moisture space. According to the liquid spray apparatus 1A having the above stated complex effects, the space having the healthy and the healing effect to the human being is provided.

Further, when the pressure pump 2 starts, since the liquid droplets scatter necessarily from the spray port 11, it is necessary to prevent the scattering of the liquid droplets. It is necessary to mitigate the dynamic energy of the abrupt discharge in the flow passage liquid during the starting of the pressure pump 2. In the liquid spray apparatus 1A of the above stated embodiment according to the present invention, since the flat plate cover 6 having the flat shape in the lower face is installed to a finish end portion of the flow passage 10*d*, the dynamic energy of the discharge liquid is mitigated in the flow passage 10*d*.

In the liquid spray apparatus 1A of the above stated embodiment according to the present invention, to make the air purification (the air cleaning) effect large, the melon shape thin film spray body WF1 in which the contact are with the air is made larger than that of the spherical shape of the embodiment and a stable thin film spray body FW1 in which the film cut off phenomenon does not occur is obtained.

Further, the surface tension and the viscosity force which are the characteristics of the liquid itself is put to practice use, further the swirl movement of the liquid which is generated by the blades 3*a* of the pressure pump 2 is put to practice use. The inner wall 5*a* of the conduit tube 5 reaching to the spray port 11 forms with the curvature shape and the curvature shape inner wall 5*a* is applied to the launch stand in which the liquid is flied toward the outer peripheral direction. Herein, the swirl movement indicates that the clothing fabric of the fluid in which the warp yarn of the flow direction of the fluid and the weft yarn according to the swirl movement are produced. As a result, in the liquid spray apparatus 1A of the above stated embodiment according to the present invention, before the swirl movement of the liquid disappears, the liquid is sprayed from the spray port 11.

Further, in the liquid spray apparatus 1A of the above stated embodiment according to the present invention, since the flat plate cover 6 is installed to make smoothly the surface of the liquid which is sprayed from the spray port 11, the load of the pressure pump 2 reduces and then a small size and a low sound pump employs. The liquid sprayed from the spray port 11 runs down without the film cut off and collides with the outer surface p12 without the scattering of the liquid droplets. The generated sound must be comfortable. The comfortable water sound indicates the sound near to the little stream. To make the comfortable sound, according to the experimentation by the inventors, in this embodiment, it is necessary to the flow amount of the liquid less than about 10 liters/minute. As a result, the discharge amount of the pressure pump 2 and the diameter and the thickness of the thin film spray body WF1 are determined.

The size of the thin film spray body WF1 will be studied. In a case where the pressure pump 2 having an alternating current specification employs, the characteristic of the pressure pump 2 varies according to the difference of the power supply frequency and the size of the thin film spray body WF1 varies. Further, according to the combination of the constituting components, the size of the thin film spray body WF1 varies. It is necessary to form the structure in which the above stated fluctuation elements are absorbed and the adjustment is carried out. Since the size of the thin film spray body WF1 is determined according to the discharge amount of the liquid and the flow passage area of the spray port 11, the space between the finish end of the conduit tube 5 and the flat plate cover 6 is adjusted by changing the thickness of the spacer 8.

Namely, the engagement between the conduit tube 5 and the flat plate cover 6 is carried out with the screw manner and to the engagement portion the overlapped thin plates or the flexible spacer 8 are intervened, a minute adjustment is carried out. According to the experimentation of the inventors, when the flow amount of the liquid is 10 litter/minute, the diameter of the thin film spray body WF1 fluctuates about 2 cm every 0.05 mm of the space of the spray port 11. Further, according to the slackness between the peak and the root of the screw member since the shape of the thin film spray body WF1 becomes the ellipse shape and the eccentric shape, by the overlapped thin plates or the flexible spacer 8 the peaks and the roots of the screw member is fastened always.

The cold-water ablutions etc. pile up to the passage inner wall of the liquid spray apparatus 1A and the flow of the liquid obstacles. Accordingly, it is necessary to form the decomposition structure in which the maintenance such as the cleaning working is carried out easily. According to the present invention, the apparatus employs the structure in which it can decompose to four (4) constituting components except for the installation screw members.

To obtain the good installation performance of the interior main body on which the liquid spray apparatus is mounted, the supply manner of the liquid to be used employed suitably a circulation manner but not a piping manner. When the liquid is used to circulate, with the lapse of time the liquid has the rotting (bacteria, algae, fungus etc.) and the bat smelling generates. The human being having the allergic constitution will impair his health. The use water is the common water to which the smelling of chlorine is added and sterilizes the bacteria in the water, however in the present invention, it has the continuous sterilization effect against all microorganisms and using the environment decontaminating chemical in which polyhexamethylene, biguanide, hydrothioride are compound synthesized as a main component is diluted (0.2%), it can provide the safety and the low cost.

Next, the operation of the liquid spray apparatus 1A according to the present invention will be explained. After the pressure pump 2 starts, the liquid having the kinetic energy flows into the conduit tube 5 and collides with the inner wall flat face 6*b* of the flat plate cover 6 which is arranged to the spray port 11 and the energy is mitigated and reaches to the spray port 11 and the melon shape thin film spray body WF1 having no film cut off generates from the spry port 11.

The generated thin film spray body WF1 adsorbs and removes the floating gas and the minute particles with the lapse of time and the air purification continues. The actual measured data is shown in FIG. 6. The measurement condition is that the substances (gases, dusts) to be subjected have entered into the seal chamber of 1 $m^3$ and in the used liquid the flow amount is 10 litters/minute, the diameter of the melon shape thin film spray body WF1 is 22 cm and the film thickness is 1.5 mm.

The main specifications in the experimentation will be explained. The regal standards of the pressure pump 2 are 50/60 Hz, the consumption electric power is 15/18 W, the flow amounts are 10/12 liters/minute.

The diameter, the length and the thickness of the melon shape thin film spray body WF1 are about 22 cm, 260 mm, and 1.5 mm. Further, the diameter, the length of the liquid spray apparatus 1A are 40 mm and 80 mm.

An actual measurement data of an adsorption removal of the gases being float in air and the micro particles of this embodiment according to the present invention is shown in FIG. 6. The main performances in this embodiment are the water amount of about 10 liters/minute, a surface area of the thin film spray body WF1 of about 2,4000 $cm^2$, a thickness of the thin film spray body WF1 of about 1.5 mm, and a pulsation width of the thin film spray body WF1 of about 1–3 mm.

A measurement manner of the adsorption removal of the gases being floated in air and the micro particles will be explained. A cubic type seal box having an inner volume of 1 $m^3$ was used, in a central inner portion of the seal box the apparatus accommodating the pure water according to the present invention was placed and the substances (gas shape) to be measured was added to the seal box and at the same time the liquid spray apparatus 1A was operated to start. The lapse time (hr) and the concentration (ppm or gr) in the liquid were measured.

According to the actual measurement data, the thin film of the pulsated spray body WF1 adsorbs in a short time the gases in air and the micro-particles.

The collection performance relates to the solubility of the substances to be measured against the water. The apparatus had the superior collection to nicotine being the harmful substance, formaldehyde, ammonia and pollen. The apparatus had adsorbed and removed the chlorine being the molecular level and toluene which were caught hardly in the general filter type air cleaner and had caught small nitric acid and sodium being the metal dusts which were the representative substances in the exhaust gas in the automobile. Since toluene has the low water solubility performance, it carries out the adsorption and the exhalation.

Further, the generation amount of hydroxyl ions ($H_3O_2^-$) being the minus ions was about 1,000 numbers/$cm^3$ which corresponds to that of the suburbs forester. Further, the air cleaning performance and the generation of the minus ions relate to the water amount, the surface area and the pulsation number.

An interior B on which a liquid spray apparatus 2A shown in FIG. 7 of another embodiment according to the present invention is mounted will be explained. This embodiment is a model for suitable in a place where the human being gathers. In an inner side center of a pottery water ball 2B (diameter of about 40–50 cm), a partition plate 21 is installed, and in a lower portion of the partition plate 21 a water pump 22 is arranged and to an upper portion a glass tower 20 is mounted and they are assembled. On an upper portion of the glass tower 20, the liquid spray apparatus 2A is mounted and in an interior portion of the glass tower 20 a light luminescence member is provided. In the light luminescence member, the eight color lights change in successively every five minutes and LSD on which the water sealing treatment is carried out is mounted. In a spherical shape thin film spray body WF2, the water and the light move and then a fantasy space directs.

An interior C on which a liquid spray apparatus 3A shown in FIG. 8 of a further embodiment according to the present invention is mounted will be explained. This embodiment is a model in which an elegance water harp (suikin) sound is heard. In a center of a pottery water ball 3B (diameter of about 30–40 cm) a pottery cylindrical tower 30 is installed, the liquid spray apparatus 3A is used by mounting an upper face recessed portion 30*a* of the cylindrical tower 30. Herein, a small hole 30*b* which leaks the liquid between the upper face recessed portion 30*a* of the cylindrical tower 30 and the liquid spray apparatus 3A is provided, the liquid runs down into the cylindrical tower 30 as the liquid droplets, the run down sound of the liquid droplets echoes to the inner wall of the cylindrical tower 30 and then the water harp sound is heard. A pressure water pump is received in the cylindrical tower 30.

Figure 7:
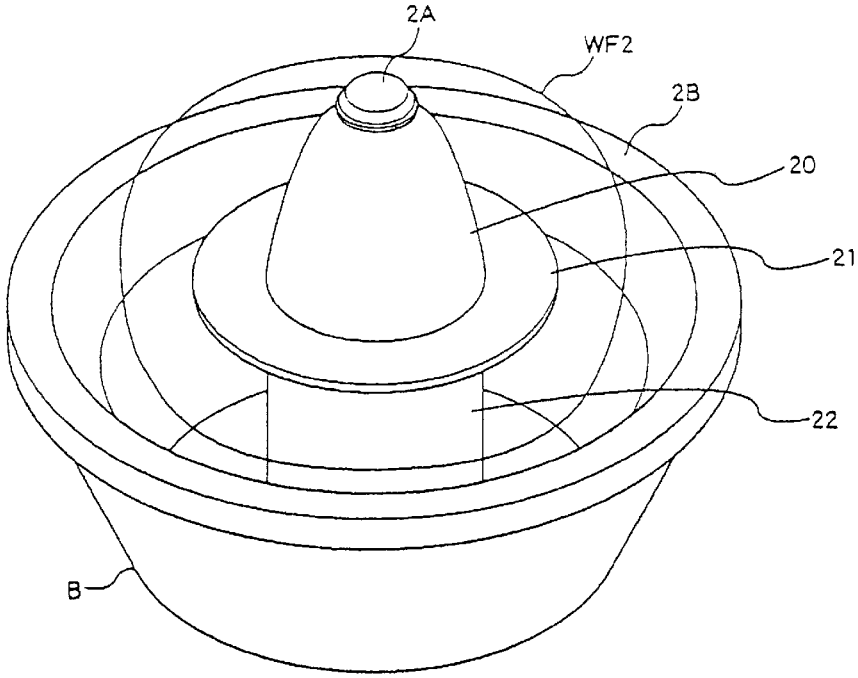
FIG. 7 is an outer appearance perspective view showing an interior on which a liquid spray apparatus of another embodiment according to the present invention is mounted.
Figure 8:
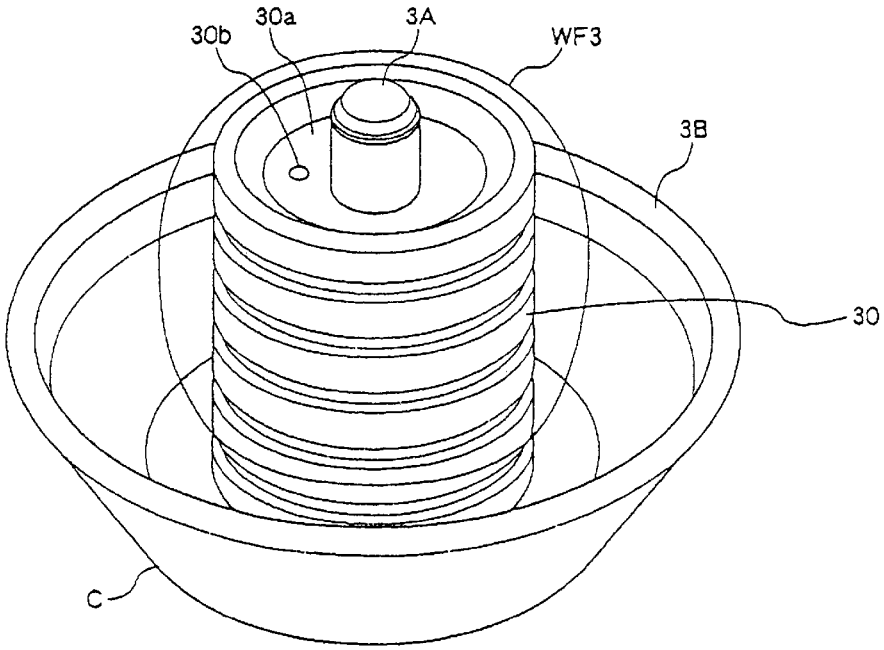
FIG. 8 is an outer appearance perspective view showing an interior on which a liquid spray apparatus of a further embodiment according to the present invention is mounted.

Every of the liquid spray apparatuses of the embodiments shown in FIG. 1, FIG. 7 and FIG. 8 generate the melon shape thin film spray body and the spray continues. Further, during the starting of the pressure pump, it admits no scattering of the liquid droplets. Further, the member for preventing surely the scattering of the liquid droplets is attained by rotating the flat plate cover toward the slackening direction and making large the space of the spray port and making small the outer diameter of the spray body.

According to the fountain apparatuses being the liquid spray apparatuses 1A, 2A and 3A of the embodiments according to the present invention, in addition to the above stated air purification effect and the minus ions generation effect, since the fountain apparatus is installed in the indoor room, the interior having the healing effect is provided.

According to the fountain apparatuses being liquid spray apparatuses 1A, 2A and 3A of the embodiments according to the present invention, the air purification in the residence space and the supply of the minus ions and the fountain in the indoor room and the healing by the addition of the plants act complex and the healthy space realizes.

A fountain apparatus being a liquid spray apparatus shown in FIG. 9 of a further embodiment according to the present invention will be explained referring to FIG. 9.

Figure 9:
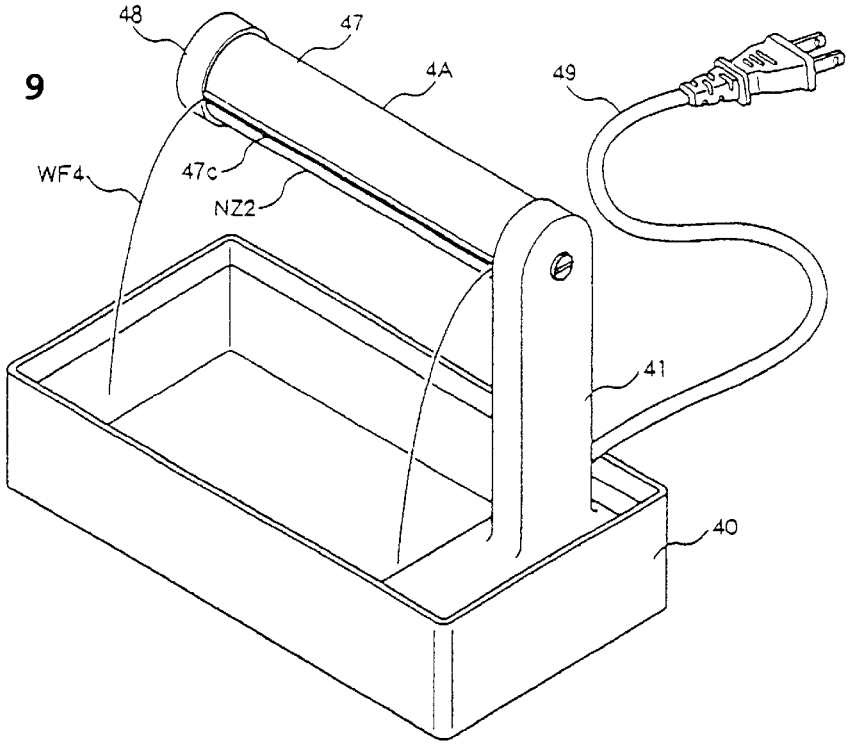
FIG. 9 is an outer appearance perspective view showing a liquid spray apparatus of another embodiment according to the present invention.
Figure 10:
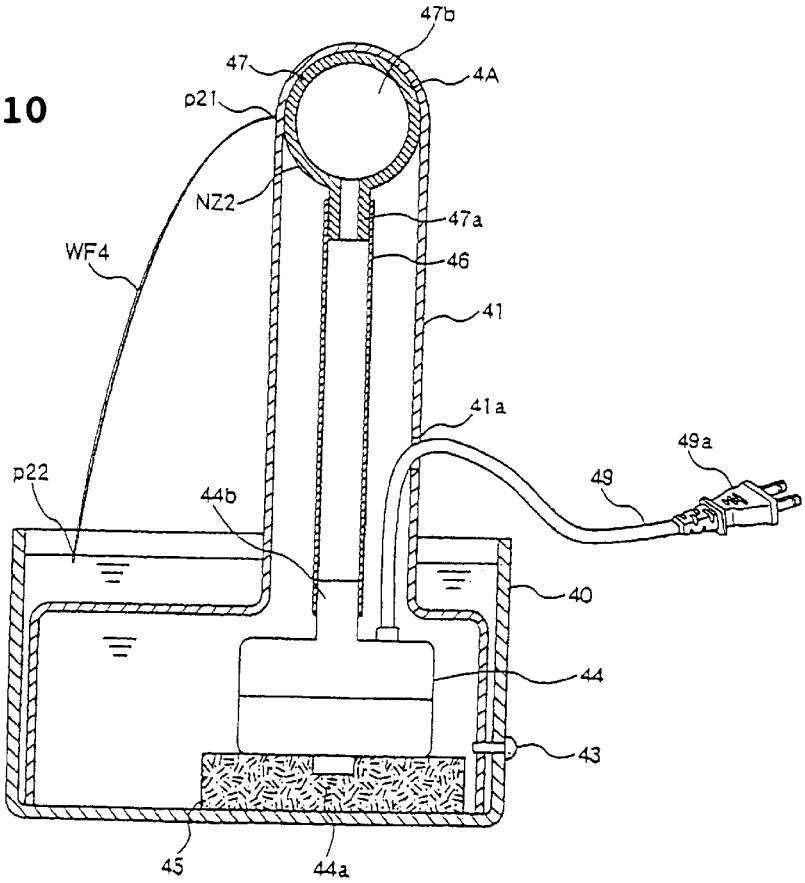
FIG. 10 is a cross-sectional view showing the liquid spray apparatus of another embodiment according to the present invention.
Figure 11:
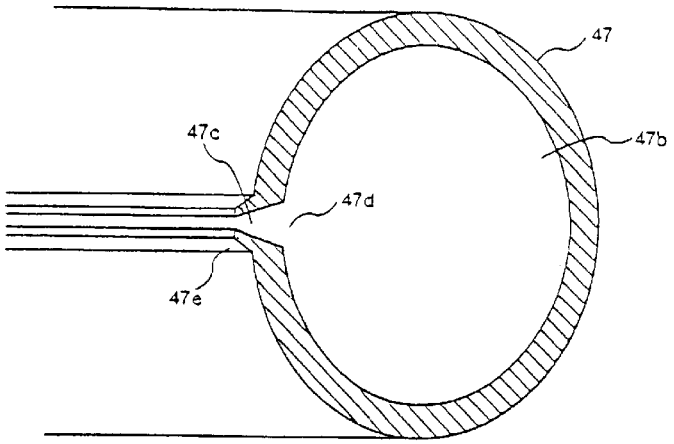
FIG. 11 is a cross-sectional perspective view showing a nozzle of the liquid spray apparatus of another embodiment according to the present invention.
Figure 12:
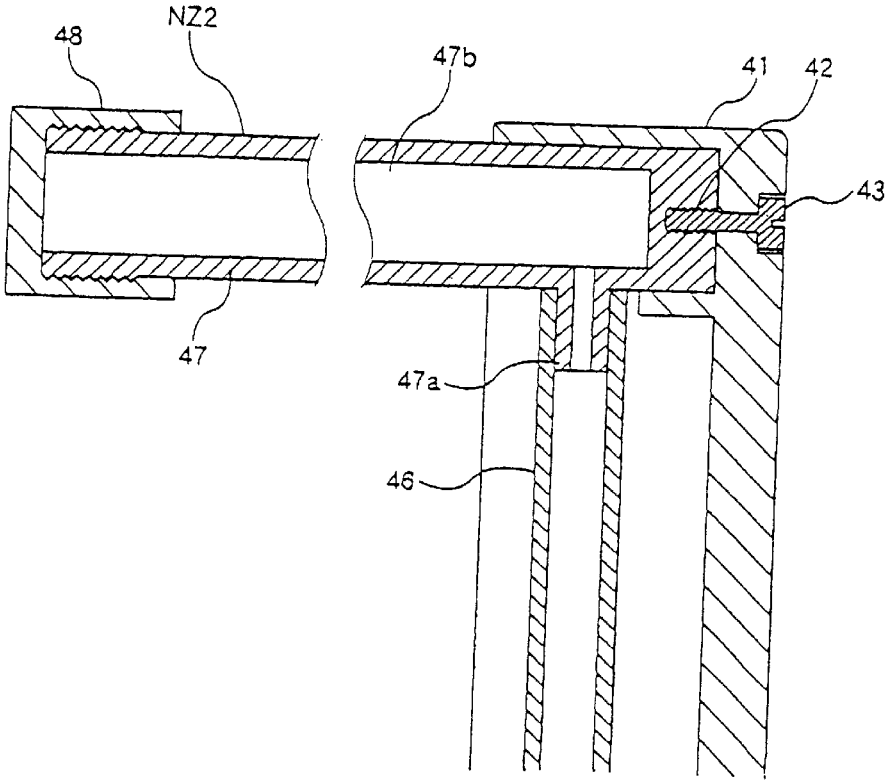
FIG. 12 is a cross-sectional view showing a nozzle unit of the liquid spray apparatus of another embodiment according to the present invention.

FIG. 9 is an outer appearance perspective view showing a liquid spray apparatus (a fountain apparatus) of a further embodiment according to the present invention, FIG. 10 is a cross-sectional view showing the liquid spray apparatus of the further embodiment according to the present invention, FIG. 11 is a cross-sectional perspective view of a nozzle of the liquid spray apparatus of the further embodiment according to the present invention, and FIG. 12 is a cross-sectional perspective view of a nozzle unit of the liquid spray apparatus of the further embodiment according to the present invention.

A fountain apparatus 4A comprises mainly a vessel 40 for receiving the liquid (water), a supporting stand 41 which is supported in an inner side end portion of the vessel 40, a nozzle unit NZ2 mounted on an upper portion of the supporting stand 41, and a pressure water pump 44. The supporting stand 41 carries out the waterproof treatment from a back face of the vessel 40 and is fixed using a screw member 43. The water pump 44 has a suction port 44*a* and a discharge port 44*b*, and a lower portion of a vicinity of the suction port 44*a* a vibration-prevention filter 45 is arranged.

The vibration-prevention filter 45 absorbs the vibrations due to the operation of the pressure pump 44 and works a role of a filter for purifying the sucked water. Since a nozzle 47 of the nozzle unit NZ2 is manufactured by a drawing product such as the stainless steel and the anti-corrosion aluminum, etc., there is no limitation of the length of the nozzle 47. As a result, it corresponds to the aim for providing the equipment of the fountain apparatus in the long distance.

A discharge port 44*b* of the water pump 44 and a receiving port 47*a* of the nozzle unit NZ2 are connected with a flexible hose 46. A power supply code 49 of the water pump 44 is drawn out from a code passing-through hole 41*a* of a back face side of the supporting stand 41 and a plug 49*a* is inserted into a socket the operation starts.

By the operation of the water pump 44, the water passed through the vibration-prevention filter 45 reaches to the discharge port 44*b*, the hose 46, and a receiving port 47*a* and fills up in a nozzle chamber 47*b*. A flow passage cross-sectional area of a spray port 47*c* of the nozzle unit NZ2 is formed with a linear and slender shape to reduce for directing from an inner side port 47*d* of the nozzle 47 to an outer side port 47*c*, as shown in FIG. 12. A wall face of the flow passage is formed with a mirror finishing face.

To a joining portion between the supporting stand 41 and the nozzle unit NZ2, a groove screw member 43 is provided to pass through a screw hole 42. To this groove screw member 43, a tip end of a tool is inserted into and an angle of a spray direction of the nozzle unit NZ2 is adjusted. By slackening the groove screw member 43, the nozzle unit NZ2 is removed from the supporting stand 41. Further, to a finish end portion of the nozzle unit NZ2 a cap 48 is mounted and carries out the water-sealing. A cleaning working of the nozzle chamber 47*b* is carried out by removing the cap 48.

Next, a practical use method and an operation motion will be explained. First of all, the water is entered to the vessel 40 with a predetermined water level, the plug is inserted into the socket and the operation starts. From the spray port 47*c* the transparent thin film spray body WF4 (fountain) is sprayed with the pulsation.

When the operation time passes, since the liquid (water) in the vessel 40 includes the dirt in the air and gets dirty, an exchange over of the liquid is necessary periodically. The frequency degree for the exchange over of the liquid is in inverse proportion to the water amount, it is desirable to exchange over with every weeks. Further, in the vessel 40, when the natural stone such as tourmaline is inserted, the exchange over degree of the liquid is made slow, then the nasty can be restrained.

In the fountain apparatus being the liquid spray apparatus of this embodiment, with respect to a size of the spray port 47*c* of the nozzle unit NZ2, a width in the outer side port is 1 mm, and a length is 60 cm (height 40 cm). Further, the thin film spray body WF4 pulsates like as a single sheet paper toward a radial direction (a radius direction) by drawing with a substantial ¼ arc shape and runs down without the film cut off to a water face p22 which is a desirable run down point from an outlet point p21 of the spray port 47*c*.

An example of the run down of the liquid droplets being the thin film spray body WF4 is shown in FIG. 10. Namely, the liquid droplets reach with a curvature shape to the water face p22, which is the desirable run down point, from the outlet point p21 of the spray port 47*c* of the nozzle unit NZ2. The arc shape thin film spray body WF4, which is sprayed from the linear shape spray port 47*c*, is an aggression of the linear shape liquid flow and sprays with the curvature shape and further this thin film spray body WF4 runs down to the water face p22 by pulsating without the film cut off.

According to the fountain apparatus 4A being the liquid spray apparatus of this embodiment according to the present invention, by the pressure pump 44 the pressure in water of the flow passage is risen and to the discharged fountain the pressure is added. In the spray port 47*c*, to the discharged water the restraint is added and then in the midway of the run down it causes hardly the film cut off (no film cut off) and the pulsating thin film spray body WF4 is obtained.

In the case of the embodiments of the thin film spray body WF4 is the linear shape body or the parabola shape body, when to the liquid body the swirl movement is given, the liquid body is easily cut off during the run down. However in this embodiment since the swirl inertia is stood still, plural enlargements and reductions are given to the cross-sectional area of the flow passages, then the swirl movement is restrained.

Figure 13:
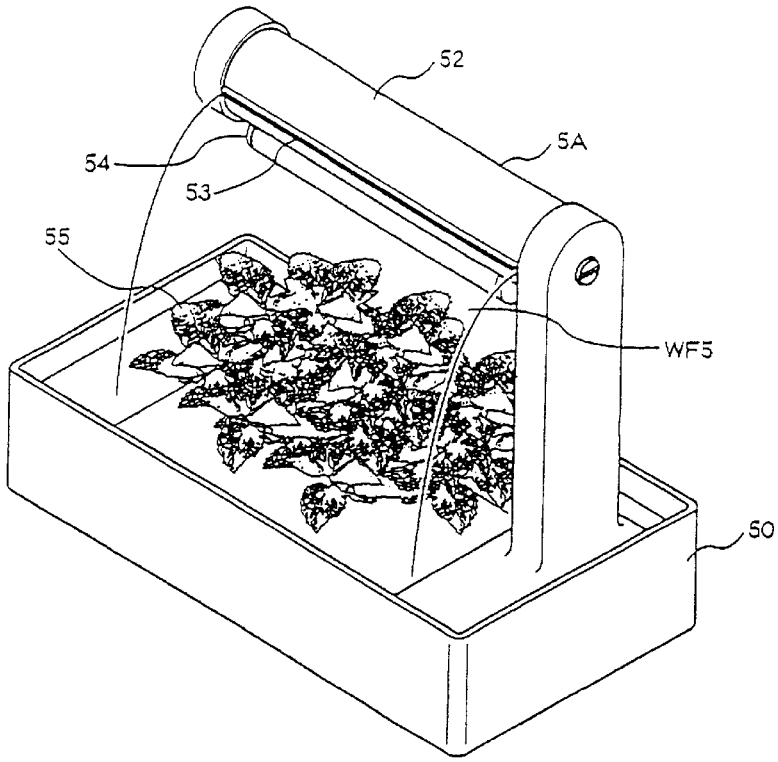
FIG. 13 is an outer appearance perspective view showing a liquid spray apparatus of a further embodiment according to the present invention.
Figure 14:
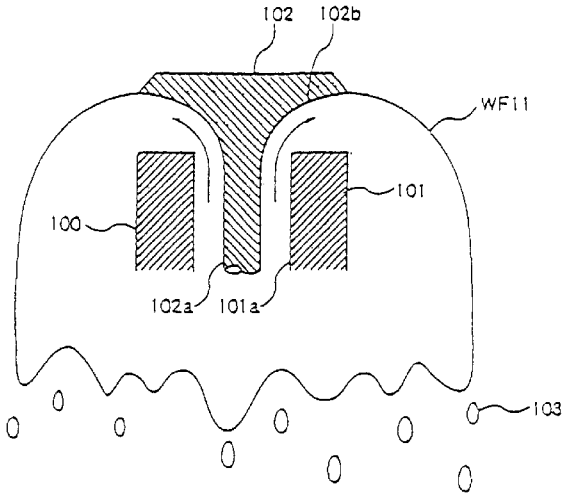
FIG. 14 PRIOR ART
FIG. 14 is a cross-sectional view showing one liquid spray apparatus of a liquid spray apparatus according to the prior art.
Figure 15:
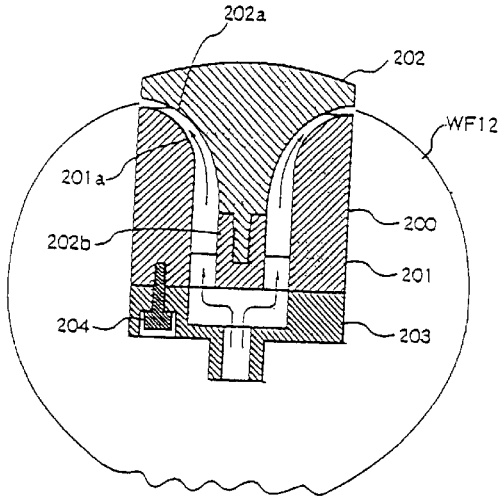
FIG. 15 PRIOR ART
FIG. 15 is a cross-sectional view showing another liquid spray apparatus of a liquid spray apparatus according to the prior art.

FIG. 13 shows a fountain apparatus being a liquid spray apparatus 5A of a further embodiment according to the present invention. In this fountain apparatus 5A, to a vessel 50 plants 55 are provided. The indoor room plants 55 provide at the same time the healing due to the visual sensation. As the plants 55, it is desirable to employ the moss and the hydroponics plants.

In this fountain apparatus 5A, a straight type high color rendering property fluorescent 54 is installed to a lower face of a nozzle 52. As a result, the fluorescent 54 serves as a lighting device and as a light source supply to the plants 55. Further, from a spray port 53 the pulsating spray body (the fountain) WF5 sprays, to a film surface the light is projected and then a fantastic visual world directs.

According to the liquid spray apparatus according to the present invention, the melon shape thin film spray body having the large surface area can be generated, the generated thin film spray body hardly occur the film cut off phenomenon and also the liquid droplets scattering during the starting can be prevented.

Further, the melon shape thin film spray body having the large surface area can carry out the purification action in the air in the indoor room and further according to Lenard effect when the thin film liquid sprays and when the spray body runs down and collides, the generated minus ions can be supplied to the indoor room.

What is claimed is:

1. In a liquid spray apparatus comprising a liquid pressurizing means having a suction port for inhaling the liquid and a discharge port for discharging the liquid and for pressurizing the liquid, a liquid passage forming member communicated to said discharge port of said liquid pressurizing means, and a nozzle unit communicated to a discharge side of said liquid passage forming member and having a liquid spray port, the liquid sprayed from said liquid spray port of said nozzle unit is formed with a thin film shape liquid, the liquid spray apparatus is characterized in that said liquid pressurizing means generates a liquid pressure fluctuation to the liquid and gives a pulsation movement on a surface of said thin film shape liquid and further gives a swirl component to said thin film shape liquid; and said thin film shape liquid sprayed from said liquid spray port of said nozzle unit is maintained in a thin film figuration to a desirable run down point without a film cut off, said nozzle unit mitigating pressure of the liquid which is pressurized abruptly upon starting the liquid pressurizing means, whereby during start of flow of liquid upon starting the liquid pressurizing means, liquid droplets from said liquid spray port of said nozzle unit do not scatter.

2. The liquid spray apparatus according to claim 1, wherein said nozzle unit comprises a first nozzle member having an upper portion of an inner wall thereof that has a spreading curved face, and a second nozzle member arranged on said upper portion of the first nozzle member and having a flat lower face.

3. The liquid spray apparatus according to claim 1, wherein said nozzle unit comprises a first nozzle member having an upper portion of an inner wall thereof that has a spreading curved face, a second nozzle member arranged on said upper portion of the first nozzle member and having a flat lower face, and a member provided between the first nozzle member and the second nozzle member and for adjusting a space of the liquid spray port.

4. The liquid spray apparatus according to claim 1, wherein the liquid pressurizing means is a pressure pump having a linear shape and radial shape blades.

5. In a liquid spray apparatus comprising a liquid means having a suction port for inhaling the liquid and a discharge port for discharging the liquid and for pressurizing the liquid, a liquid passage forming member communicated to said discharge port of said liquid pressurizing means, and a nozzle unit communicated to a discharge side of said liquid passage forming member and having a liquid spray port, the liquid sprayed from said liquid spray port of said nozzle unit is formed with a thin film shape liquid, the liquid spray apparatus is characterized in that said liquid pressurizing means gives a swirl component to the liquid and gives an inclination direction component to said thin film shape liquid and makes to run down said thin film shape liquid; and said thin film shape liquid sprayed from said liquid spray port of said nozzle unit is maintained in a thin film figuration to a desirable run down point without a film cut off, said nozzle unit mitigating pressure of the liquid which is pressurized abruptly upon starting the liquid pressurizing means, whereby during start of flow of liquid upon starting the liquid pressurizing means, liquid droplets from said liquid spray port of said nozzle unit do not scatter.

6. The liquid spray apparatus according to claim 5, wherein said nozzle unit comprises a first nozzle member having an upper portion of an inner wall thereof that has a spreading curved face, and a second nozzle member arranged on said upper portion of the first nozzle member and having a flat lower face.

7. The liquid spray apparatus according to claim 5, wherein said nozzle unit comprises a first nozzle member having an upper portion of an inner wall thereof that has a spreading curved face, a second nozzle member arranged on said upper portion of the first nozzle member and having a flat lower face, and a member provided between the first nozzle member and the second nozzle member and for adjusting a space of the liquid spray port.

8. The liquid spray apparatus according to claim 5, wherein the liquid pressurizing means is a pressure pump having a linear shape and radial shape blades.

9. In a liquid spray apparatus comprising a liquid pressurizing means having a suction port for inhaling the liquid and a discharge port for discharging the liquid and for pressurizing the liquid, a liquid passage forming member communicated to said discharge port of said liquid pressurizing means, and a nozzle unit communicated to a discharge side of said liquid passage forming member and having a ring shape liquid spray port, the liquid sprayed from said ring shape liquid spray port of said nozzle unit is formed with a ring shape thin film shape liquid, the liquid spray apparatus is characterized in that said liquid pressurizing means generates a liquid pressure fluctuation to the liquid and gives a pulsation movement on a surface of said ring shape thin film shape liquid and further gives a swirl component to said ring shape thin film shape liquid; and said ring shape thin film shape liquid sprayed from said ring shape liquid spray port of said nozzle unit is maintained in a ring shape thin film figuration to a desirable run down point without a film cut off, said nozzle unit mitigating pressure of the liquid which is pressurized abruptly upon starting the liquid pressurizing means, whereby during start of flow of liquid upon starting the liquid pressurizing means, liquid droplets from said ring shape liguid spray port of said nozzle unit do not scatter.

10. The liquid spray apparatus according to claim 9, wherein said nozzle unit comprises a first nozzle member having an upper portion of an inner wall thereof that has a spreading curved face, and a second nozzle member arranged on said upper portion of the first nozzle member and having a flat lower face.

11. The liquid spray apparatus according to claim 9, wherein said nozzle unit comprises a first nozzle member having an upper portion of an inner wall thereof that has a spreading curved face, a second nozzle member arranged on said upper portion of the first nozzle member and having a flat lower face, and a member provided between the first nozzle member and the second nozzle member and for adjusting a space of the ring shape liquid spray port.

12. The liquid spray apparatus according to claim 9, wherein the liquid pressurizing means is a pressure pump having a linear shape and radial shape blades.

13. In a liquid spray apparatus comprising a liquid pressurizing means having a suction port for inhaling liquid and a discharge port for discharging the liquid and for pressurizing the liquid, a liquid passage forming member communicated to said discharge port of said liquid pressurizing means, and a nozzle unit communicated to a discharge side of said liquid passage forming member and having a ring shape liquid spray port, the liquid sprayed from said ring shape liquid spray port of said nozzle unit is formed with a ring shape thin film shape liquid, the liquid spray apparatus is characterized in that said nozzle unit comprises a first nozzle member having an outer portion spreading curved face shape upper portion inner wall and a second nozzle member arranged on an upper portion of said first nozzle member and having a flat lower face;

said nozzle unit mitigates the pressure of the liquid pressurized abruptly which generates a starting of said fluid pressurizing means; and said ring shape thin film shape liquid sprayed from said ring shape liquid spray port of said nozzle unit is maintained in a ring shape thin film figuration to a desirable run down point without a film cut off.

14. In a liquid spray apparatus comprising a liquid pressurizing means having a suction port for inhaling liquid and a discharge port for discharging the liquid and for pressurizing the liquid, a liquid passage forming member communicated to said discharge port of said liquid pressurizing means, and a nozzle unit communicated to a discharge side of said liquid passage forming member and having a ring shape liquid spray port, the liquid sprayed from said ring shape liquid spray port of said nozzle unit is formed with a ring shape thin film shape liquid, the liquid spray apparatus is characterized in that said nozzle unit comprises a first nozzle member having an outer portion spreading curvature face shape upper portion inner wall, a second nozzle member arranged on an upper portion of said first nozzle member and having a flat lower face, and a member provided between said first nozzle member and said second nozzle member and for adjusting a space of said liquid spray port;

said nozzle unit mitigates the pressure of the liquid pressurized abruptly which generates during a starting of said fluid pressurizing means;

said ring shape thin film liquid sprayed from said ring shape liquid spray port of said nozzle unit is maintained in a ring shape thin film figuration to a desirable run down point without a film cut off; and by adjusting said spray port space adjusting member of said nozzle unit, said space of said liquid spray port is changed, and a figuration of said ring shape thin film shape liquid is compensated.

* * * * *